United States Patent [19]

Angelo, II

[11] Patent Number: 4,834,648

[45] Date of Patent: May 30, 1989

[54] ROTARY CALCINING KILN

[76] Inventor: James F. Angelo, II, P.O. Box 55275, Little Rock, Ark. 72225

[21] Appl. No.: 97,742

[22] Filed: Sep. 17, 1987

[51] Int. Cl.[4] ..... F27B 7/00

[52] U.S. Cl. ..... 432/103; 432/105; 432/126

[58] Field of Search ..... 432/103, 105, 106, 113, 432/114

[56] References Cited

U.S. PATENT DOCUMENTS

| | | | |
|---|---|---|---|
| 1,706,592 | 11/1925 | Ryder . | |
| 2,187,922 | 1/1940 | West et al. . | |
| 2,850,273 | 9/1958 | Barnes . | |
| 3,011,772 | 12/1961 | Rouanx | 432/105 |
| 3,279,892 | 10/1966 | Lesser et al. . | |
| 3,404,199 | 10/1968 | Hoffmann . | |
| 3,580,554 | 5/1971 | Bushuev et al. . | |
| 3,842,762 | 10/1974 | Sargent et al. . | |
| 3,888,621 | 6/1975 | Williams | 432/103 |
| 3,901,766 | 8/1975 | Smith . | |
| 4,037,543 | 7/1977 | Angelo . | |
| 4,259,081 | 3/1981 | Reuter et al. | 432/105 |
| 4,345,896 | 8/1982 | Abernathy, Jr. et al. | 432/103 |
| 4,377,978 | 3/1983 | Eusner | 432/105 |
| 4,437,835 | 3/1984 | Martin | 432/103 |
| 4,459,921 | 7/1984 | Unger | 432/103 |
| 4,462,793 | 7/1984 | Maeda et al. | 432/105 |
| 4,464,111 | 8/1984 | Rastogi et al. | 432/106 |
| 4,551,051 | 11/1985 | Hofbauer et al. . | |
| 4,671,765 | 6/1987 | Tsai | 432/13 |

*Primary Examiner*—Henry C. Yuen

*Attorney, Agent, or Firm*—John A. Hamilton

[57] ABSTRACT

A calcining kiln for decontaminating and detoxifying materials, such as earth, contaminated by hazardous chemicals and substantially incapable of autogenous combustion, consisting of an elongated kiln body through which the material to be treated is conveyed in the form of a tumbling bed, and apparatus for directing flame jets of high temperature against and into the tumbling bed at closely spaced intervals along the length of the kiln body to stir and agitate the material. The tumbling and the stirring and agitation reduce the material to a pulverized form of fine particle size so that all of the contaminating chemicals may be reached and destroyed by the high temperature flame jets. Various fuel gases may be used depending on the heat producing capacity required under any particular circumstances, and the heat produced in successive longitudinally spaced zones of the kiln body may be independently controlled according to the heat requirements in each zone.

6 Claims, 2 Drawing Sheets

ROTARY CALCINING KILN

This invention relates to new and useful improvements in kilns, and has particular reference to a kiln for use in the detoxification of soil or earth containing toxic and hazardous chemicals

BACKGROUND OF THE INVENTION

The contamination of soil or earth with various toxic and hazardous chemicals is becoming more and more common. The use of such materials as PCB, TNT, and solvents such as toluene, xylene, and trichloroethane in agricultural and industrial applications, is becoming more and more common, and often leads to the contamination thereby of soil or earth, which must then be classified as extremely hazardous material. The decontamination and detoxification of such material presents certain problems. While the chemicals themselves may be combustible, or capable of being destroyed or rendered harmless by extreme heat, the soil is not. The soil is largely inorganic material, and is not capable of autogenous combustion, so that it cannot be burned, and as a result will often protect the chemicals intermixed therein from combustion, or from the heat necessary to render them harmless, if attempts are made to "burn" the earth or otherwise to subject it to high degrees of heat. A device which will perform this decontamination and detoxification efficiently and reliably would obviously be a substantial and valuable contribution to the art.

SUMMARY OF THE INVENTON

The principal object of the present invention is the provision of a kiln in which the feedstock, earth or the like, is moved continuously through the kiln in the form of a tumbling bed, adn is subjected for the whole time it remains in the kiln to flame jets provided by an external fuel such as natural gas, oxygen or propane The flame jets not only raise the feedstock temperature to the very high level required for calcining, perhaps 2500–3000 deg. Fahr., but also stir or agitate the material in the bed to insure that the substantially incombustible material will be very thoroughly pulverized to fine particle size, which in turn insures that all of the contaminating chemicals mixed with the earth are thoroughly exposed to maximum heat for the combustion or thermal destruction thereof. I have elected to denote the process as calcination, which is believed to be accurate.

Another object is the provision of a calcining kiln of the character described into longitudinally successive zones of which fuel gas and combustion air may be introduced in independently regulatable amounts. In this manner the heat requirements dictated by the stage to which the calcination has advanced in each kiln zone may be accomodated.

A further object is the provision of a calcining kiln of the character described having means operable to direct cooling gases, such as air or nitrogen, into the kiln to cool the fuel gas and combustion air supply means, in order to protect the structural integrity of these elements against the extreme heat of calcination, without at the same time preventing the application of the calcining heat to the feedstock.

A still further object is the provision of a kiln of the character described which may alternatively be used to treat combustible material capable of augtogeneous flame, the extreme heat being useful in guaranteeing a complete burnout of the carbon of such materials.

Other objects are simplicity and economy of construction, and efficiency and dependability of operation.

DESCRIPTION OF THE PREFERRED EMBODIMENT

Figure 2:
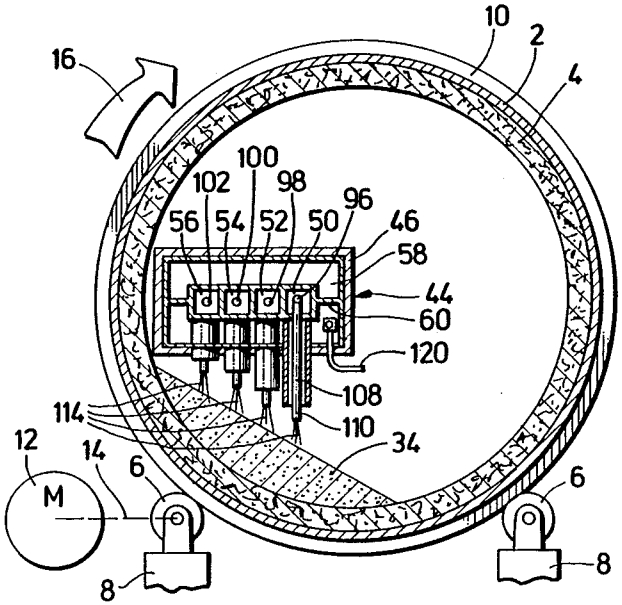
FIG. 2 is an enlarged sectional view taken on line II—II of FIG. 1.

Like reference numerals apply to similar parts throughout the seveal views, and the numeral 2 applies to an elongated cylindrical kiln disposed with its axis inclined slightly from horizontal, and provided with a lining 4 of suitable refractory or ceramic material. It is supported for rotation about its axis by pairs of rollers 6 distributed along its length, said roller being carried by ground-engaging bases 8 and engaging metal tracks 10 surrounding the kiln. At least one of said rollers is driven rotatably by a variable speed electric motor 12 (see FIG. 2) through a driving connection 14 therebetween, whereby the kiln may be rotated at any desired speed, turning in a clockwise direction as indicated by arrow 16 in FIG. 2. Said kiln is closed at its upper end by a fixed end wall 18, and at its lower end by a fixed end wall 20, said end walls being supported by ground-engaging bases 22, and leakage of air or gas between the end walls and the interior of the kiln is prevented by seals 24. The material to be calcined, such as earth contaminated with toxic chemicals or the like, may be fed continuously into a hopper 26, and from there forced by a ram feeder 28 driven by a variable speed electric motor 30 into the kiln through an aperture 32 provided therefor in upper end wall 18. Rotation of the kiln by motor 12, and the inclination of the kiln from horizontal, then causes the feed material to progress downwardly along the incline of the kiln in the form of a tumbling bed 34, as indicated in FIG. 2. The material bed will tend to climb upwardly along the ascending side of the kiln, until it reaches its normal angle of repose, and will then tumble toward the bottom of the kiln by gravity. The rate of rotation of the kiln, and the rate of supply of fuel gas and combustion air to the kiln, as will be described, is so selected that the bed 34 is maintained throughout the length of the kiln. At the lower end of the kiln, the remaining residue of the calcining process, consisting largely of the finely pulverized earth particles resulting from the calcination, and possibly ash, will pass through an aperture 36 provided therefor in lower end wall 20, into a conduit 38, and thence through a quencher 40, and finally transported by an auger conveyor 42 to a subsequent station for disposal or further processing.

Figure 1:
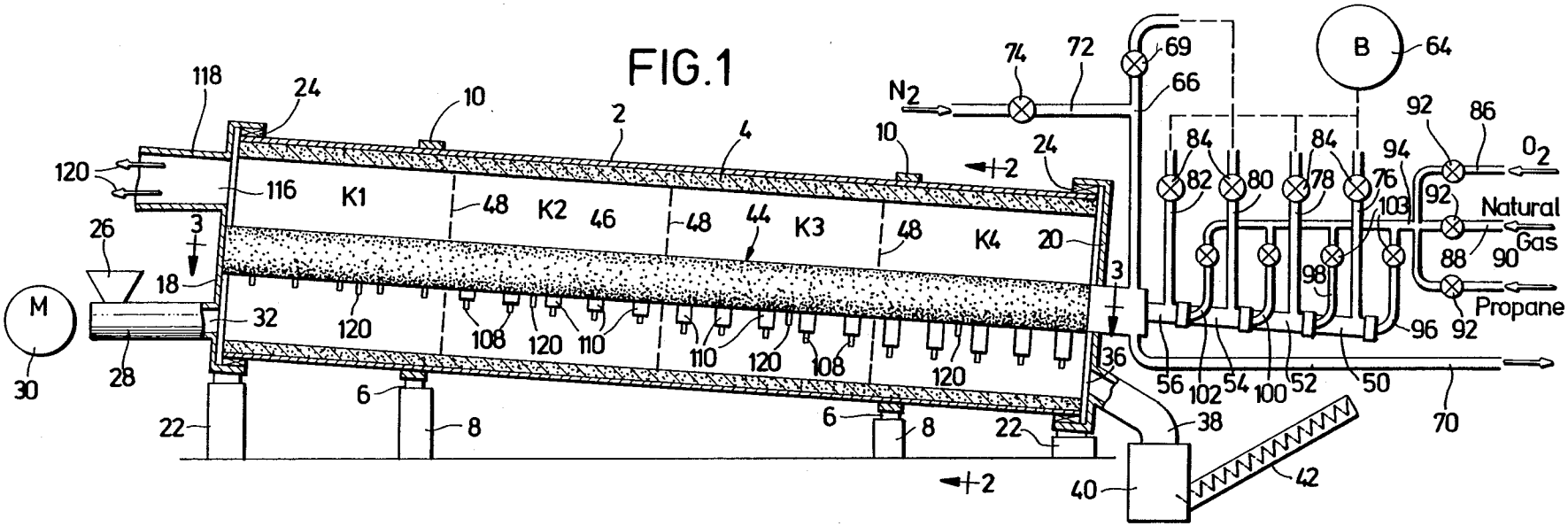
FIG. 1 is a partially schematic vertical longitudinal sectional view of a calcining kiln embodying the present invention, with parts omitted and left in elevation.
Figure 3:
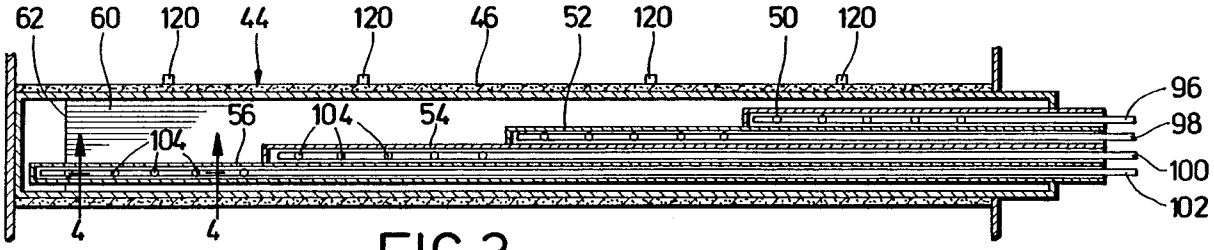
FIG. 3 is a fragmentary sectional view taken on line III—III of FIG. 1.

A cooling plenum chamber 44, illustrated as a sheet metal tube of rectangular cross-sectional contour, extends through and is supported by lower end wall 20, and then extends through the full length of the kiln, being supported at its upper end by upper end wall 18. It is disposed parallel to the kiln axis, but is laterally offset from said axis to lie directly over bed 34, as best shown in FIG. 2, and is provided with an external coating 46 of refractory or ceramic insulation material. As shown in FIG. 1, the length of the kiln may be considered to be divided by imaginary lines 48 into longitudinally successive zones K1, K2, K3 and K4. A cluster of four air ducts 50, 52, 54 and 56 extend in side by side relation through the capped lower end of plenum chamber 44, and each is operable to deliver air to only one of the kiln zones K1 through K4, extending only through the zone to which it is intended to supply air. The cluster of ducts 50–56 occupies only a portion of the cross-sectional area of the plenum chamber, leaving a space 58 within the plenum chamber surrounding ducts 50–56, through which air or other cooling gas may be circulated. The space 58 is divided into upper and lower portions by a partition wall 60, said partition wall extending from the lower end of the plenum chamber but terminating short of the forward end of the plenum, as indicated at 62 in FIG. 3. Air, supplied by a power-driven blower 64, is supplied to the upper portion of space 58 by a pipe 66 controlled by a valve 69 for cooling purposes, the air thus supplied being forced to travel the full length of the kiln, around the forward end of partition wall 60, and back to the lower end of the plenum chamber, where it is exhausted to atmosphere through pipe 70. Other cooling gases, such as nitrogen, may alternatively be supplied to the plenum chamber through a pipe 72 controlled by a valve 74, when greater cooling capacity is required.

Figure 4:
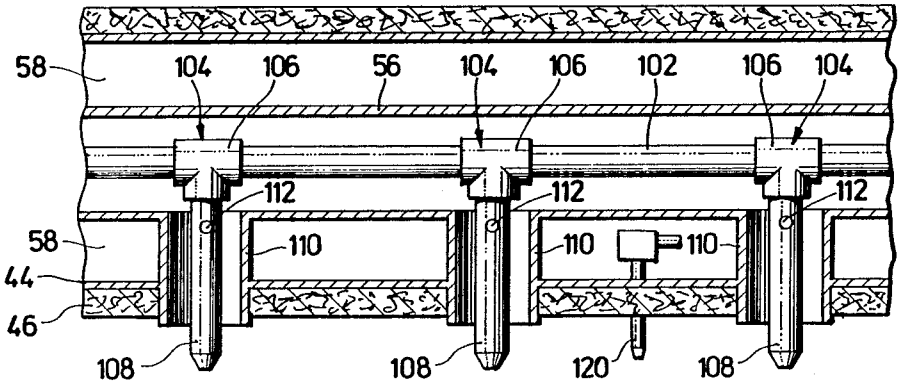
FIG. 4 is an enlarged, fragmentary sectional view taken on line IV—IV of FIG. 3.

Blower 64 is also operable to deliver air to each of ducts 50, 52, 54 and 56 through a series of pipes 76, 78, 80 and 82, each under the control of a separate regulating valve 84, these pipes being interconnected into said ducts outwardly from lower end wall 20. A plurality of fuel gases, such for example as natural gas, oxygen, or propane, are introduced into the system at 86, 88 and 90, each under the regulating control of a separate valve 92, and thus delivered selectively or in any desired proportions to a common pipe 94, the gas used depending primarily on the degree of heat required in the kiln. From pipe 94, the gas is delivered through four fuel pipes 96, 98, 100 and 102, each controlled by a regulating valve 103, respectively into the outer ends of air duct 50, 52, 54 and 56. Each fuel pipe extends through the full length of its associated duct. Within the portion of each fuel pipe traversing the kiln zone K1, K2, K3 or K4 to which it is to supply gas, and only within that zone, a series of flame nozzles 104 are interconnected into said pipe. As shown in FIG. 4, each of said flame nozzles comprises a T-fitting 106 interposed in said pipe and a nozzle pipe 108 engage in said T-fitting and projecting downwardly through a larger pipe 110 which is fitted at its upper end into the associated duct 52–56 and projects downwardly through air plenum 58 and its insulating jacket 46 into the kiln above bed 34. Air from the associated duct enters the nozzle pipe through a hole 112 formed in said pipe adjacent T-fitting 107 to provide an ample supply of primary air to insure through ignition for the fuel gas, and air from the duct passing downwardly through pipe 110 provides a secondary air supply for insuring full combustion of the gas. The initial ignition of the gas emerging from the nozzles may be electric spark, or by any other suitable means, not shown. The flame jets 114 emerging from the nozzles, as shown in FIG. 2, are directed downwardly against and into bed 34, with sufficient force to stir and agitate the material contained in said bed.

Operation of the kiln is believed to be reasonably self-evident from the foregoing description of its construction. The toxically contaminated earth or other feedstock not capable of autogeneous combustion is introduced into the higher end of the kiln at 32, and travels therethrough in the form of a tumbling bed 34, all as previously described. The fuel gas and combustion air introduced by fuel pipes 96–102 and air ducts 50–56 create flame jets 114 which subject the feedstock to extremely high temperatures, and which also agitate and stir the feedstock at the same time. The tumbling and stirring tend to break up and pulverize the feedstock into very fine particle size in a calcining process, although the feedstock is not capable of autogenous combustion and largely does not burn. The breakdown of the feedstock into fine particle size insures that all of the contaminating chemicals will be directly subjected to the intense heat of the flame jets and thus be either burned or thermally destructed to render them harmless, not being insulated from the heat by incombustible masses of the feedstock. The gaseous products of the calcining operation are led off through an aperture 116 formed in upper end wall, through a conduit 118 to a stack or the like, not shown, capable of creating a draft in the direction of arrows 120.

The division of the kiln into zones K1–K4, and the provision of introducing independently regulatable amounts of gas and combustion air to each of these zones, provides that ony the required amount of heat need be generated in each zone. As the calcination process progresses along the length of the kiln, less and less heat is required, and corresondingly the addition of excessive heat to any zone could be both wasteful of fuel and possibly dangerous to the structural integrity of the structure. The provision of cooling gas in plenum chamber 58, as well as the insulation coating 46 of said chamber, further protects the gas and air pipes traversing the kiln from heat damage, and protects against possible premature ignition of the gas.

Mounted along the length of plenum chamber 44 are a series of data-collection devices 120, which may for example comprise thermocouples, gas sampling tubes or the like, capable of measuring various factors such as temperatures and gas make-up at all stages of the process, in all zones of the kiln. The plenum chamber thus serves as a data-collecting "base" capable of protecting the devices 120 against the extreme heat of the remainder of the kiln by reason of the cooling of the chamber by the cooling air or other gas circulating therein. The elements 120 might otherwise be completely destroyed by such heat. Thus a basis for a completely automated control system is provided.

While I have shown and described a specific embodiment of my invention, it will be readily apparent that many minor changes of structure and operation could be made without departing from the spirit of the invention.

I claim:

1. A calcining kiln for decontaminating earth or other feedstock material incapable of autogeneous combustion to remove hazardous chemicals therefrom, said kiln comprising:

a. a holllow, axially rotatable elongated kiln body, b. means operable to introduce said feedstock material into one end of said kiln body, c. means operable to cause said feedstock material to move through the length of said kiln body in the form of a tumbling bed, d. means operable to direct jets of flame toward and into said tumbling body of material at closely spaced intervals along the length of the kiln body, whereby to stir and agitate the bed material to assist in the reduction of said bed material to a pulverized form of fine particle size in a calcining process, including a series of jet nozzles disposed in closely spaced relation along the length of the kiln body, and directed downwardly toward said bed and means operable to deliver fuel gas and combustion and air to each of said nozzles, said fuel gas and combustion air delivering means comprising:
   1. a pipe system for delivering fuel gas to each of said nozzles,
   2. an air deck system for delivering combustion air to each of said nozzles, said fuel pipe and air deck systems extending longitudinally through said kiln body,
   3. a plenum chamber surrounding the portions of said fuel pipe and air duct systems within said kiln body, and
   4. means operable to circulate a flow of cooling gas through said plenum chamber, whereby to protect said fuel pipe and air duct systems against the extreme heat of the calcining process occurring within said kiln body; and e. means operable to remove the residue of said clacining process from the opposite end of the kiln body.

2. A calcining kiln as recited in claim 1 with the addition of means operable to deliver any of a plurality of cooling gases selectively to said plenum chamber, the gas being selected according to the cooling capacity required.

3. A calcining kiln as recited in claim 1 with the addition of means operable to deliver any of a plurality of fuel gases selectively to said flame jets, the gas being selected according to the heat producing capacity required in the calcining process occurring within the kiln body.

4. A calcining kiln as recited in claim 1 wherein said means for delivering fuel gas and combustion air to said nozzle is additionally operable to deliver independently regulated and controlled quantities of gas and air to the nozzles disposed within each of a series of longitudinally successive zones of said kiln body, whereby to produce only the amount of heat required for the calcining process in each of said zones.

5. A calcining kiln as recited in claim 4 wherein said fuel gas and combustion air delivery means is additionally operable to deliver any of a plurality of fuel gases selectively and in independently controlled and regulated amounts to each of the longitudinally successive zones of said kiln body.

6. A calcining kiln as recited in claim 1 with the addition of a series of data-collection devices, such as thermocouples and gassampling tubes, mounted within said plenum chamber and distributed along the length of the kiln, said devices being protected from the extreme heat of the remainder of the kiln by the cooling gas circulating through said plenum chamber.

* * * * *